US005273473A

United States Patent [19]

Allen

[11] Patent Number: 5,273,473

[45] Date of Patent: Dec. 28, 1993

[54] FLOTATION APPARATUS

[76] Inventor: D. Mason Allen, 9202 Beauclerc Circle West, Jacksonville, Fla. 32257

[21] Appl. No.: 59,968

[22] Filed: May 13, 1993

[51] Int. Cl.[5] ..... B63B 59/02

[52] U.S. Cl. ..... 441/129; 441/40; 114/219

[58] Field of Search ..... 114/219; 441/35, 40, 441/44, 45, 46, 125, 129

[56] References Cited

U.S. PATENT DOCUMENTS

| | | | |
|---|---|---|---|
| 534,275 | 2/1895 | Meyer | 441/40 |
| 1,151,435 | 8/1915 | Bair | 441/40 |
| 1,456,168 | 5/1923 | Witmer et al. | 441/40 |
| 2,355,757 | 8/1944 | Spanel | 441/40 |
| 3,292,566 | 12/1966 | Russell | 114/219 |
| 3,332,094 | 7/1967 | Vorenkamp | 441/35 |
| 4,343,258 | 8/1982 | Belvedere | 114/219 |
| 4,358,866 | 11/1982 | Rhodes | 441/35 |
| 4,815,761 | 3/1989 | Henderson | 441/129 |

*Primary Examiner*—David M. Mitchell
*Assistant Examiner*—Stephen P. Avila
*Attorney, Agent, or Firm*—William M. Hobby, III

[57] ABSTRACT

A flotation apparatus utilities a pair of boat fenders to rapidly make a general purpose flotation raft. A pair of boat fenders is utilized with a pair of rigid members each wrapped with flotation material and which are removably attachable to the boat fenders with cords extending from the boat fenders to hold the boat fenders in a spaced relationship to each other. A flexible cloth has a pair of side sleeves attached over the rigid members and is removably attached around each boat fender to form a platform for the flotation device. Each of the pair of rigid members has an aperture in each end thereof for receiving the flexible cord extending from the boat fender therethrough for removably attaching the rigid member at each end to one of the boat fenders and the flexible cloth may have a pair of end portions having a plurality of apertures therethrough so that a flexible cord can attach each end portion around one boat fender. When disassembled, the two rigid members can be rolled within the flexible cloth for compact storage within a boat and then using the boat fenders to be assembled for a rapid life raft or flotation raft for working on a boat or the like.

12 Claims, 1 Drawing Sheet

FLOTATION APPARATUS

BACKGROUND OF THE INVENTION

The present invention relates to a flotation apparatus and especially to a flotation apparatus utilizing existing boat fenders to form a utility raft or life raft.

In the past, it has been common to use a variety of boat fenders which are typically resilient cylinders made of an inflatable or other polymer material, such as a foamed plastic, which has flexible cords attached therethrough and extending therefrom for attaching to the boat. The boat fenders can be tied to cleat sand dropped over the side of a boat when the boat is being pulled up to a pier or dock to prevent damage to the boat and also to protect the boat when tied up or moored around other boats or in boat houses or adjacent piers or docks.

The present invention is adapted to provide a compact kit which can take the boat fenders and rapidly make a life raft or flotation raft utilizing the existing fenders on the boat as components and which can be compactly stored and rapidly assembled as needed. The kit has flotation so that it can be assembled in the water.

Prior U.S. patents for life rafts and flotation devices include the Greene U.S. Pat. No. 1,089,338 for a life raft, which uses a pair of pontoons bolted together and connected therebetween to form a life raft and which includes its own boat fender. The Iwanitz U.S. Pat. No. 3,093,849, shows a boat safety attachment in which a boat flotation attachment is attached around the edge of the boat similar to a boat fender. The Rosendahl U.S. Pat. No. 412,417, shows a life saving apparatus having a pair of flotation logs connected together and having looped ropes attached thereto for holding onto. The Baswitz U.S. Pat. No. 772,690, shows a life buoy having a folding pair of semi-circular tubes having a net attached therearound and also having handles for holding onto. The Hessel U.S. Pat. No. 829,472, shows a life saving device having flotation cells connected in a square and a net extending under the open center portion and also having hand grips and cork floats along the side. The Trevisan U.S. Pat. No. 1,029,729, shows a life saving device having a singular large pontoon with attached life buoys extending therefrom. The Tabulo U.S. Pat. No. 1,107,632, is a life saving appliance for use at sea having a pair of pontoons movably attached to each other and having a support surface therebetween. The Walters U.S. Pat. No. 2,050,138, is for a life saving apparatus having various configurations but which uses a buoy having a hollow flotation body with a plurality of ropes attached therearound.

The present invention is adapted to provide a compact flotation unit for storage on a boat which can be rapidly unrolled and attached to existing boat fenders to provide a convenient utility raft or life raft and which can be quickly disassembled and compactly restored when not in use.

SUMMARY OF THE INVENTION

A flotation apparatus utilizes a pair of boat fenders to rapidly make a general purpose flotation raft. A pair of boat fenders is utilized with a pair of rigid members covered in a flotation material which are removably attachable to the boat fenders with cords extending from the boat fenders to hold the boat fenders in a spaced relationship to each other. A flexible cloth has a pair of side sleeves attached over the rigid members and is removably attached around each boat fender to form a platform for the flotation device. Each of the pair of rigid members has an aperture in each end thereof for receiving the flexible cord extending from the boat fender therethrough for removably attaching the rigid member at each end to one of the boat fenders and the flexible cloth may have a pair of end portions having a plurality of apertures therethrough so that a flexible cord can attach each end portion around one boat fender. When disassembled, the two rigid members can be rolled within the flexible cloth for compact storage within a boat and then using the boat fenders to be assembled for a rapid life raft or flotation raft for working on a boat or the like.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
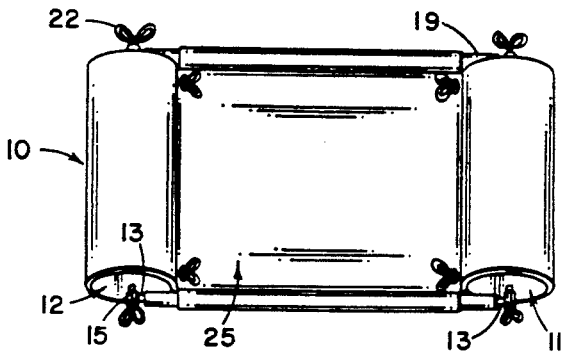
FIG. 1 is a perspective view of a flotation device in accordance with the present invention.

Referring to the drawings and especially to FIGS. 1–5, a flotation apparatus 10 can be seen having a pair of boat fenders 11 and 12 attached thereto in FIG. 1 with supporting rigid members or bars 13 and 14. Each rigid member 13 and 14 has an end 15 having an aperture 16 therein and each is mounted to a protruding shaft 17 which may be threaded to adjust the length of each rigid member 13 and 14. The members 13 and 14 are covered with a flotation material 19, such as a polymer foam, to give flotation to the kit so that it can be assembled in the water without sinking. Each boat fender 11 and 12 has a cord 18 extending from one end and 20 extending from the other end of a generally cylindrical flotation rubber boat fender body 21. Cords 18 and 20 may be one cord extending through the body 21 formed thereto. Cords 18 and 20 could normally be tied to a boat, such as to cleats on the bow of the boat, so that the fender body 21 can be dropped over the side of the boat and held by the cords 18 and 20 attached to the cleats. In this case, the fenders 12 are removed from the attachment to the boat and the cords 18 and 20 27 threaded through the aperture 16 in the rigid members 13 and 14 with one fender attached to either end. Cords 18 and 21 can then be tied in a knot 22 to hold the fenders in spaced relationship to each other, as shown in FIG. 1. Prior to attaching the boat fenders, however, the rigid members 13 and 14 are wrapped with flotation foam 19 then slipped through a pair of sleeves 23 and 24 formed in the flexible cloth 25. The rigid members 13 and 14 may be rigidly attached to the cloth 23, 24 if desired with the cords 18 and 20 attached to each end.

The cloth 25 has an end portion 26 on one end and an end portion 27 at the other end. Each end portion has a pair of openings 28 and 30 in the corners thereof with grommets 31 mounted therein for threading a flexible cord 32 therethrough and having a knot 33 formed in one end. The end portion 26 can then be wrapped around a boat fender 11 and the cords 32 threaded through a second pair of openings 34 also having grommets 35 therethrough for attaching the end portion 26 at the flexible cloth 25 around the boat fender 11. Similarly, a pair of flexible cords 36 can be threaded through a pair of apertures 37 in the end 27 of the cloth 25 and through a pair of grommets 38. The cord 36 can be threaded through the apertures 40 having grommets 41 to wrap the end portion of the cloth 27 around the boat fender 12 and attaching it therearound.

Figure 2:
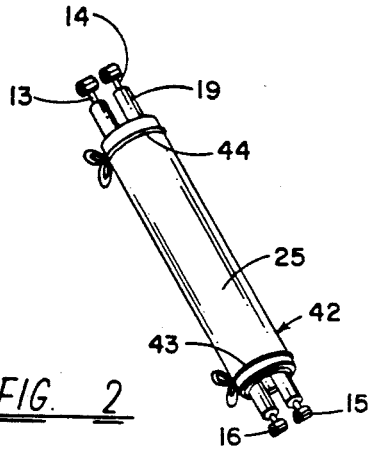
FIG. 2 is a perspective view of a flotation device packed for storage.
Figure 3:
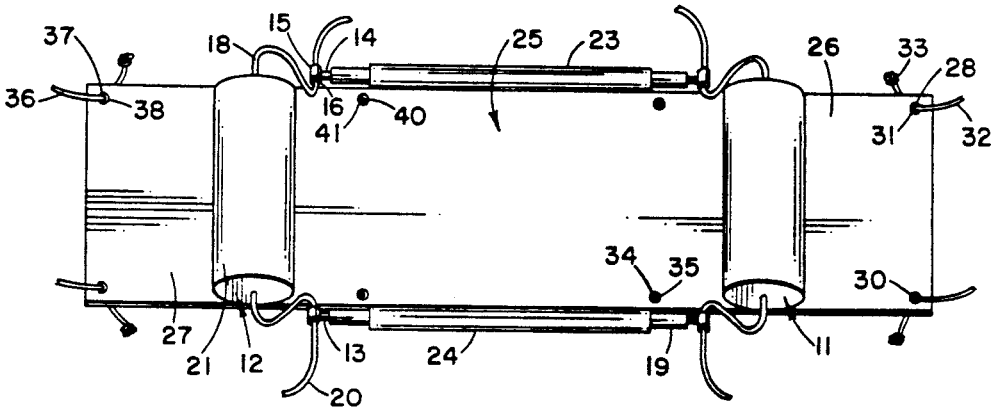
FIG. 3 is a perspective view of the flotation device of FIG. 1 during assembly.
Figure 4:
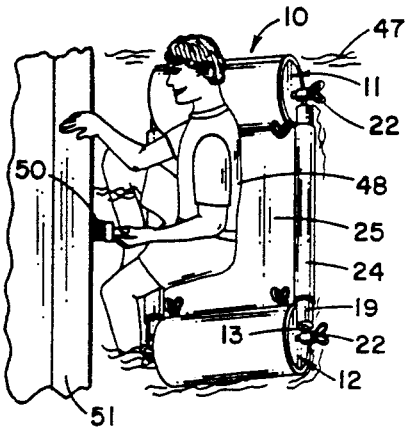
FIG. 4 is a perspective view of the flotation device of FIGS. 1–3 being utilized by a person working on a boat hull.
Figure 5:
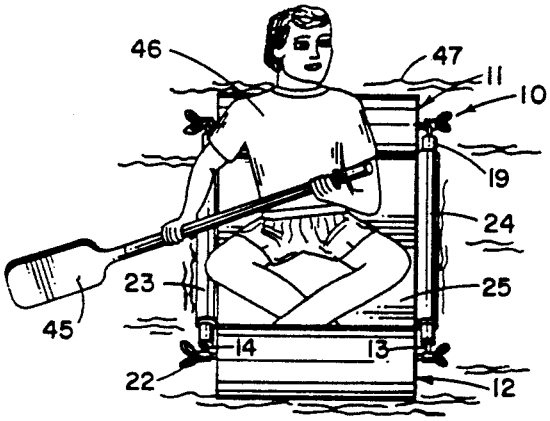
FIG. 5 is a perspective view of the flotation device of FIGS. 1–3 with an individual in a paddling position.

In operation, the cloth 25 can be wrapped around the rigid members 13 and 14 and the flotation covering 19 thereover which may already be inserted in the sleeves 23 and 24 and rolled up, as shown in FIG. 2. The cords 32 and 36 can either be placed within the bundle 42, which can be tied with cords 43 and 44, but the cords 43 and 44 may also utilize the cords 32 and 36. Thus, a compact storage is provided, as seen in FIG. 2, which can be rapidly unrolled and attached to a pair of boat fenders 11 and 12, as shown in FIG. 3, with the ends 26 and 27 tied around the fenders 11 nd 12 with the cords 32 and 36. Once the flotation raft is assembled, it can be utilized as a life raft completely with a disassembled paddle 45 for use by a stranded sailor 46, as shown in the water 47 in FIG. 5. Alternatively, the flotation device 10 can be used in FIG. 4 with a workman 48 using a paintbrush 50, in this case, floating in the water 47 for painting the side of a boat 51 or for hull work as desired. Advantageously, the present invention can be compactly stored for rapid assembly for use as a life raft or utility raft and which can be as easily disassembled for convenient storage with the fender bumpers placed back on the boat for use in docking the boat. However, the present invention is not to be construed as limited to the forms shown which are to be considered illustrative rather than restrictive.

I claim:

1. A flotation apparatus comprising:

a pair of boat fenders, each said boat fender having a flexible cord extending from each end thereof;

a pair of rigid members removably attachable to said pair of boat fenders to hold said pair of boat fenders in a spaced relationship to each other, each said rigid member having an adjustable extension thereon;

attaching means for attaching each end of each of said pair of rigid members to each of said boat fenders, said attaching means including an aperture in each end portion of each rigid member; and an elongated flexible cloth having a pair of end portions and being shaped to fit between said pair of spaced boat fenders when said boat fenders are attached together with said pair of rigid members, said elongated flexible cloth having a pair of elongated sleeves extending generally parallel to each other for holding one said rigid member in each said sleeve between said pair of boat fenders, whereby a pair of boat fenders can be rapidly converted to a flotation device.

2. A flotation apparatus in accordance with claim 1 in which each said rigid member is covered with a flotation material.

3. A flotation apparatus in accordance with claim 2 in which each of said flexible cloth pair of elongated sleeves is attached to one rigid member for holding one said rigid member thereto.

4. A flotation apparatus in accordance with claim 2 in which each said rigid member adjustable extended threaded end includes a portions for changing the spacing between said boat fenders.

5. A flotation apparatus in accordance with claim 2 in which each said rigid member has an aperture in each end thereof whereby each said flexible cord may be attached through one rigid member aperture.

6. A flotation apparatus in accordance with claim 5 in which said flexible cloth has a pair of apertures therethrough in each end portion thereof for tying a flexible cord therethrough for attaching said flexible cloth around each said boat fender.

7. A flotation apparatus in accordance with claim 6 in which said flexible cloth has four apertures in each end portion thereof for attaching said flexible cloth around each said boat fender with a flexible cord attached through pairs of apertures.

8. A flotation apparatus in accordance with claim 7 in which each said flexible cloth aperture has a grommet mounted therein.

9. A flotation apparatus in accordance with claim 8 in which said boat fender is cylindrically shaped with a flexible cord extending axially therethrough.

10. A flotation apparatus in accordance with claim 9 in which each said rigid member is a cylindrical metal member having an opening through each end thereof.

11. A flotation apparatus in accordance with claim 10 in which said boat fender is a generally cylindrical inflatable rubber member.

12. A flotation apparatus in accordance with claim 11 in which said flexible cloth is a flexible polymer cloth.

* * * * *